United States Patent [19]

Fischer et al.

[11] Patent Number: 4,820,482

[45] Date of Patent: Apr. 11, 1989

[54] CEMENTED CARBIDE BODY WITH A BINDER PHASE GRADIENT AND METHOD OF MAKING THE SAME

[75] Inventors: Udo K. R. Fischer, Vallingby; Erik T. Hartzell; Jan G. H. Akerman, both of Stockholm, all of Sweden

[73] Assignee: Santrade Limited, Lucerne, Switzerland

[21] Appl. No.: 47,004

[22] Filed: May 5, 1987

[30] Foreign Application Priority Data

May 12, 1986 [SE] Sweden ..... 8602146

[51] Int. Cl.[4] ..... B22F 00/00; C22C 32/00

[52] U.S. Cl. ..... 419/15; 419/18; 419/29; 501/87; 501/93; 75/241; 75/242

[58] Field of Search ..... 501/93, 87; 419/14, 419/15, 18, 29; 75/241-242

[56] References Cited

U.S. PATENT DOCUMENTS

| | | | |
|---|---|---|---|
| 1,246,165 | 5/1914 | Ruzicka | 501/93 |
| 2,285,900 | 6/1942 | Dawihi | 75/136 |
| 2,939,796 | 2/1958 | Wolff et al. | 501/93 |
| 2,942,335 | 6/1960 | Wellborn | 501/93 |
| 3,329,487 | 7/1967 | Sowko et al. | 29/182.7 |
| 3,419,415 | 12/1968 | Dittreit | 501/93 |
| 3,463,621 | 8/1969 | Kieffer | 501/93 |
| 3,490,901 | 1/1970 | Hachisuka | 501/93 |
| 3,661,599 | 5/1972 | Hollox et al. | 501/93 |
| 3,804,034 | 4/1974 | Stiglich, Jr. | 501/93 |
| 3,999,953 | 12/1976 | Kolaska et al. | 29/182.7 |
| 4,022,584 | 5/1977 | Rudy | 228/122 |
| 4,035,541 | 7/1977 | Smith et al. | 428/217 |
| 4,046,517 | 9/1977 | Soga | 501/93 |
| 4,049,876 | 9/1977 | Yamamoto et al. | 428/932 |
| 4,066,451 | 1/1978 | Rudy | 75/240 |
| 4,097,275 | 6/1978 | Horvath | 75/203 |
| 4,139,374 | 2/1979 | Yih et al. | 75/204 |
| 4,150,195 | 4/1979 | Tobioka et al. | 428/548 |
| 4,225,344 | 9/1980 | Fujimori et al. | 75/203 |
| 4,265,662 | 5/1981 | Miyake et al. | 75/238 |
| 4,330,332 | 5/1982 | Schachnez et al. | 501/93 |
| 4,368,788 | 1/1983 | Drake | 175/374 |
| 4,432,794 | 2/1984 | Holleck | 75/239 |
| 4,472,351 | 9/1984 | Gonczy | 501/93 |
| 4,642,003 | 2/1987 | Yoshimura | 408/144 |

FOREIGN PATENT DOCUMENTS

| | | | |
|---|---|---|---|
| 54-50408 | 4/1979 | Japan | 501/93 |
| 59-184718 | 10/1984 | Japan | 501/93 |

*Primary Examiner*—William R. Dixon, Jr.
*Assistant Examiner*—Andrew Griffis
*Attorney, Agent, or Firm*—Burns, Doane, Swecker & Mathis

[57] ABSTRACT

The present invention relates to a cemented carbide body, preferably for rock drilling, mineral cutting and wear parts, in which the content of binder phase in the surface is lower and in the center higher than the nominal content. In the center there is a zone having a uniform content of binder phase. The WC grain size is uniform throughout the body.

11 Claims, 1 Drawing Sheet

CEMENTED CARBIDE BODY WITH A BINDER PHASE GRADIENT AND METHOD OF MAKING THE SAME

BACKGROUND OF THE INVENTION

The present invention relates to a sintered body of cemented carbide with varying contents of binder phase and a method of making the same.

In order to obtain good properties in cemented carbide, it is often desirable to have a tough core (with a high content of binder phase) surrounded by a more wear resistant cover (having a low content of binder phase).

One method of attaining this effect is to make a sintered body with a tough and less wear resistant carbide grade in the center surrounded by a more wear resistant and less tough grade. During sintering however, carbide diffusion of the binder phase usually takes place which in many cases leads to the sintered body having an almost uniform binder phase cement.

A varying content of binder phase in a sintered body of cemented carbide can be obtained, however, by means of the so called compound hard metal technique. This technique uses cemented carbide powder with different grain sizes (for example, according to European patent EP No. 111 600) or has the cemented carbide body divided in zones with different grain sizes (for example, according to GB-A No. 806 406) by which it has generally been possible to obtain a certain difference of binder pure content between different parts of the cemented carbide body. In these cases, however, no difference in wear resistance between the different parts is obtained because the fine grained part will have a greater binder phase content than the more coarse grained part.

SUMMARY AND PREFERRED EMBODIMENTS OF THE INVENTION

Figure 1:
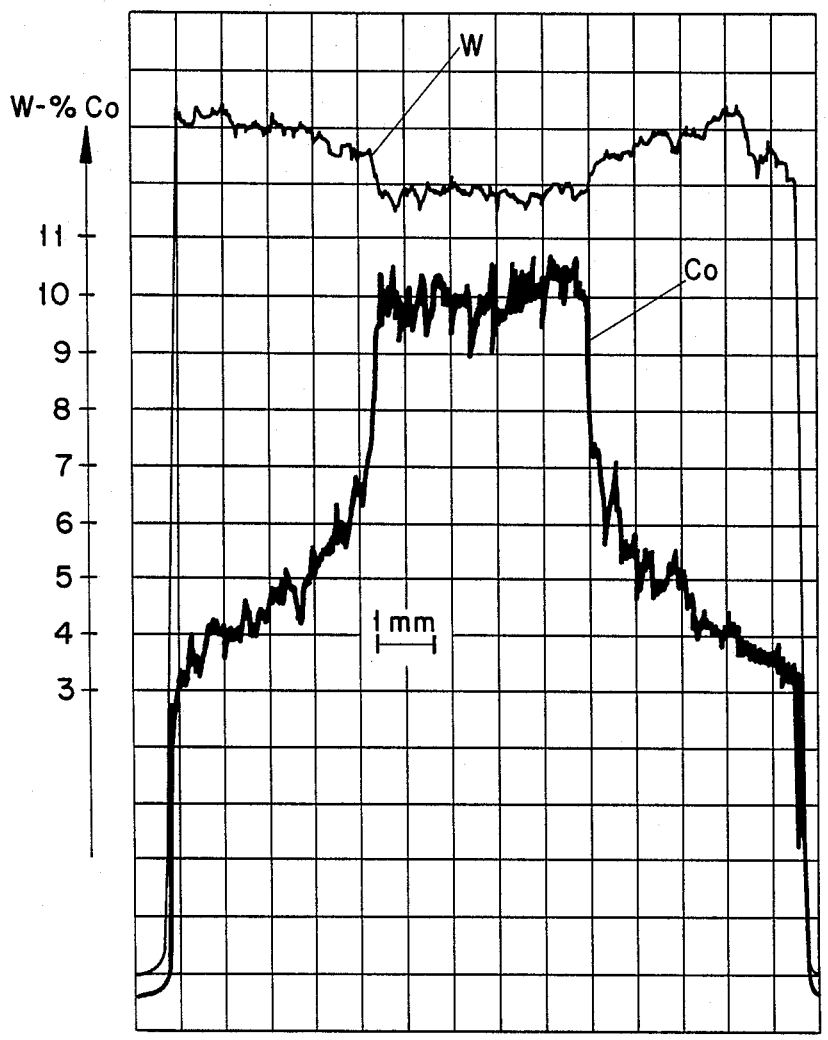
FIG. 1 is an analysis of the percent concentration of W and Co across the cross-section of a sintered body of the present invention.

It has now surprisingly been found that a body having varying binder phase contents can be obtained, starting from a essentially homogeneous powder by first making a body with a reduced content of carbon, usually 0.05–0.5%, preferably 0.1–0.4%, lower than the stoichiometric content, so that the body contains a fine-grained, uniformly distributed eta phase i.e. a phase of carbides of the metals of the alpha-(WC)- and beta-(binder)-phases often written $M_3W_3C$, wherein M is any of the Iron Group metals. The body is then carburized for a time sufficiently long that all eta phase disappears. The carburizing is performed in a carburizing atmosphere of, for example, methane, carbon monoxide, etc, at a temperature of 1200°–1550° C. The time is determined by experiments because it depends upon the size of the sintered body, temperature, etc. As a result of the carburizing treatment a body is obtained with a low content of binder phase in the surface zone (possibly along with small amounts of free graphite) and a high content of binder phase in the center.

The explanation for the obtaining of a varying content of binder phase in a cemented carbide body by carburizing an eta phase containing structure can be given by several theoretical hypotheses. These hypotheses are essentially assumptions, however, and therefore the result must be considered very surprising for a person skilled in the art. The binder phase content in the surface is 0.1–0.9, preferably 0.4–0.7, of the nominal content. The binder phase content in the center is at least 1.2, preferably 1.4–2.5, of the nominal binder phase content and it is present preferably in the form of a zone having a uniform binder phase content and an width of 0.05–0.5, preferably 0.1–0.3, of the diameter. A nominal binder phase content is obtained within 0.1–0.8, preferably 0.2–0.6, of the radius. The WC grain size is uniform throughout the body.

Compared with the prior art, in particular with cemented carbide bodies mode by the compound hard metal technique having different grain sizes and different binder metal contents, it has thus been found possible according to the invention to use principally only a single cemented carbide grade to reach the desired effect concerning a binder phase gradient with a controlled variation of the binder phase content. According to the invention, it has thus been possible to reach a considerable difference in wear resistance and toughness between the different parts of the body.

The positive effect on wear resistance and toughness depends upon the fact that the lower binder phase content in the outer part of the body in relation to the inner part leads to compressive stresses being formed in the outer part during cooling after sintering. The outer binder phase-depleted part has a smaller heat expansion that the binder phase-rich inner part. The concomitant larger amount of hard constituents (i.e., metal carbides) in the outer part also leads to an increased wear resistance.

The invention is directed to all kinds of cemented carbides for rock drilling and wear parts based upon WC having a binder phase based upon the metals of the iron group, preferably cobalt, and with a WC grain size between 0.5 and 8 μm, preferably 1–6 μm.

An alternative but less suitable way to form the cemented carbide body of the present invention is to decarburize a cemented carbide with normal structure and then carburize the same.

The invention has been described above with reference to circular or cylindrical bodies but it is naturally applicable to bodies with other cross sections such as square, rectangular, triangular, etc.

The invention is additionally illustrated in connection with the following Examples which are to be considered as illustrative of the present invention. It should be understood, however, that the invention is not limited to the specific details of the Examples.

EXAMPLE 1

From a WC 6% Co powder with 0.3% substoichiometric carbon content (5.5% C instead of 5.8% C) and WC grain size 2.5 μm, buttons were passed having a height of 16 mm and diameter of 10 mm. The buttons were pre-sintered in $N_2$-gas for 1 h at 900° C. and standard sintered at 1450° C. After that, the buttons were sparsely packed in fine $Al_2O_3$ powder in graphite boxes and thermally treated in a carburizing atmosphere for 2 h at 1400° C. in a pusher type furnace. During sintering a structure of alpha+beta phase and uniformly distributed, fine grained eta phase was formed. During the thermal treatment, there was formed in the surface of the buttons, a very narrow zone of merely alpha+beta structure because carbon begins to diffuse into the buttons and transform the eta phase to alpha+beta phase. After 4 hour's sintering time, a sufficient amount of carbon had diffused and transformed all the eta phase. The content of cobalt at the surface was determined to be 3.5% and in the center to be 10.0% in the form of a zone with about 3.5 mm diameter. The width of the part having a low content of cobalt was about 3.5 mm. See FIG. 1.

EXAMPLE 2

Tests with $\phi$45 mm rock drill bits, underground mining.

Rock:

Hard abrasive granite with small amounts of leptite. Compressive strength 2800–3100 bar.

Machine:

Atlas Corp COP 1038HD. Hydraulic drilling machine for heavy drifter equipment. Feeding pressure 85 bar, rotating pressure 45 bar, number of revolutions 200 rpm.

Bits:

$\phi$45 mm button bits. Two wings with $\phi$10 mm buttons with height 16 mm. Ten bits per variant.

Cemented carbide:

Variant 1—Standard 6% Co, 94% WC, WC grain size 2.5 $\mu$m.

Variant 2—According to the invention, 3% Co in the surface zone, 10% Co in the center. Nominal content of Co, 3 mm from the surface. The zone of Co had a diameter of 3 mm.

Drilling procedure:

The bits were drilled for 5 m holes according to "the rotation method". After every 35th drilled meter the wear was determined.

The bits were removed from the drilling at the first button damage and the number of drilled meters was noted.

| Result: | Drilled meters, $\bar{x}$ |
|---|---|
| Standard variant | 177 |
| Variant according to the invention | 204 |

EXAMPLE 3

In drawing of automatic welding wire (grade 3RS17) drawing dies were used with the dimensions 1.75, 1.57 and 1.47 mm, respectively, hole diameter. The drawing speed was 6 m/s. As cooling liquid water was used (counter flow cooling). The drawing dies, standard, were made of a cemented carbide grade with 6.0% Co, rest WC, grain size 1 $\mu$m, hardness 1750 HV. In the drawing section there were tested alternatively drawing dies of standard type and dies made according to the invention. (Starting material 6% Co, rest WC and W). In the zone close to the drawing channel the hardness was 1980 HV3 and in the inner zone 1340 HV3. The following result was obtained:

| | Tons |
|---|---|
| 1. Drawing, standard drawing die | 2.1 |
| 2. Drawing, die according to the invention | 4.0 |
| 3. Drawing, standard | 2.2 |
| 4. Drawing, invention | 3.9 |
| 5. Drawing, standard | 1.9 |
| 6. Drawing, invention | 3.8 |

Mean value, standard drawing die: 2.1 tons

Mean value, drawing die according to the invention: 3.9 tons

The drawing dies according to the invention showed a mean increase of life of 86%.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Cemented carbide body comprising WC and a binder metal selected from the group consisting of cobalt, iron, nickel and alloys thereof, the grain size of the WC being uniform throughout the body, wherein the binder metal content in the surface is from 0.1 to 0.9 and the binder metal content in the center is at least 1.2, of the nominal binder of the cemented carbide body, said cemented carbide body being essentially free of eta phase carbide.

2. The cemented carbide body of claim 1 wherein the said center of the body comprises a portion of from 0.05 to 0.5 of the diameter of the body.

3. The cemented carbide body of claim 2 wherein the said portion comprises from 0.1 to 0.3 of the diameter of the body.

4. The cemented carbide body of claim 1 wherein the binder metal content in the surface of the body is from 0.4 to 0.7 of the nominal amount of the binder metal in the body.

5. The cemented carbide body of claim 1 wherein the WC grain size is from 0.5 to 8 $\mu$m.

6. The cemented carbide body of claim 5 wherein the WC grain size is from 1 to 6 $\mu$m.

7. The cemented carbide body according to claim 1, characterized in that the content of the binder phase in the center of at least 1.4–2.5 of the nominal content of binder phase.

8. A method of making a cemented carbide body comprising (i) sintering a mixture of WC having a substoichiometric amount of carbon and a binder metal selected from the group consisting of cobalt, iron, nickel and alloys thereof to form a sintered body including WC, binder metal and eta phase carbide and then (ii) carburizing the sintered body sufficient to remove all eta phase thereby producing a carburized body having a lower binder metal content in the surface than in the center of the body.

9. The method of claim 8 wherein the carburizing is conducted at a temperature of from 1200° to 1550° C.

10. The method of claim 8 wherein the sintered body is carburized in an atmosphere of methane or carbon monoxide.

11. The method of claim 8 wherein the binder metal content in the surface is from 0.1 to 0.9, and the binder metal content in the center is at least 1.2, of the nominal binder metal of the carburized body.

* * * * *